US008950624B2

(12) United States Patent
Sacca

(10) Patent No.: US 8,950,624 B2
(45) Date of Patent: Feb. 10, 2015

(54) EXTERNALLY OPERATED ALPHA PORT SYSTEM FOR USE WITH A RAPID TRANSFER PORT

(76) Inventor: Giuseppe Sacca, Laguna Niguel, CA (US)

( * ) Notice: Subject to any disclaimer, the term of this patent is extended or adjusted under 35 U.S.C. 154(b) by 691 days.

(21) Appl. No.: 13/339,830

(22) Filed: Dec. 29, 2011

(65) Prior Publication Data

US 2013/0167442 A1 Jul. 4, 2013

(51) Int. Cl.
*B65D 43/14* (2006.01)

(52) U.S. Cl.
USPC ..... 220/825; 312/326; 312/329; 141/98; 220/315; 220/318; 220/810; 49/104

(58) Field of Classification Search
CPC ..... B01L 1/00; B01L 1/02; G21F 7/005; G21F 7/062
USPC ..... 141/98, 302; 49/73.1, 98, 104; 220/315, 220/318, 323, 810, 825; 312/1, 329; 414/217, 292; 422/295, 302; 137/614.01
See application file for complete search history.

(56) References Cited

U.S. PATENT DOCUMENTS 3,289,698 A 12/1966 Cazalis
3,665,958 A 5/1972 Dunkelis
3,682,208 A 8/1972 Fedi
4,324,344 A 4/1982 Kunz
4,494,586 A 1/1985 Picard
4,532,970 A 8/1985 Tullis
4,534,389 A 8/1985 Tullis
4,616,683 A 10/1986 Tullis
4,724,874 A 2/1988 Parikh
5,139,318 A * 8/1992 Broxup ..... 312/1
5,421,626 A 6/1995 Glachet
5,425,400 A 6/1995 Szatmary
5,460,439 A * 10/1995 Jennrich et al. ..... 312/1
5,523,519 A * 6/1996 Weber et al. ..... 588/249
5,783,156 A 7/1998 Renzi
5,857,308 A * 1/1999 Dismore et al. ..... 53/50
5,892,200 A 4/1999 Kendall
6,010,400 A 1/2000 Krainiak
6,308,749 B1 10/2001 Brossard
6,655,759 B2 * 12/2003 Sacca ..... 312/1
6,779,567 B1 8/2004 Szatmary
6,969,497 B2 * 11/2005 Sacca ..... 422/300
7,690,406 B2 * 4/2010 Giesen ..... 141/275
8,012,228 B2 9/2011 Polsky

* cited by examiner

*Primary Examiner* — Timothy L Maust
(74) *Attorney, Agent, or Firm* — Lawrence N. Ginsberg

(57) ABSTRACT

The present invention relates to an externally operated alpha port for a rapid transfer port (RTP) system such as those found in isolation barrier systems. Means are provided for the actuation by the operator of the alpha port door locking system externally of the isolation barrier to facilitate the locking and unlocking of the alpha port door without requiring gloved entry into the isolation barrier. Means are also provided for opening and closing of the alpha port door with the actuation by the operator of a lever external to the isolation barrier.

5 Claims, 8 Drawing Sheets

FIG. 2A
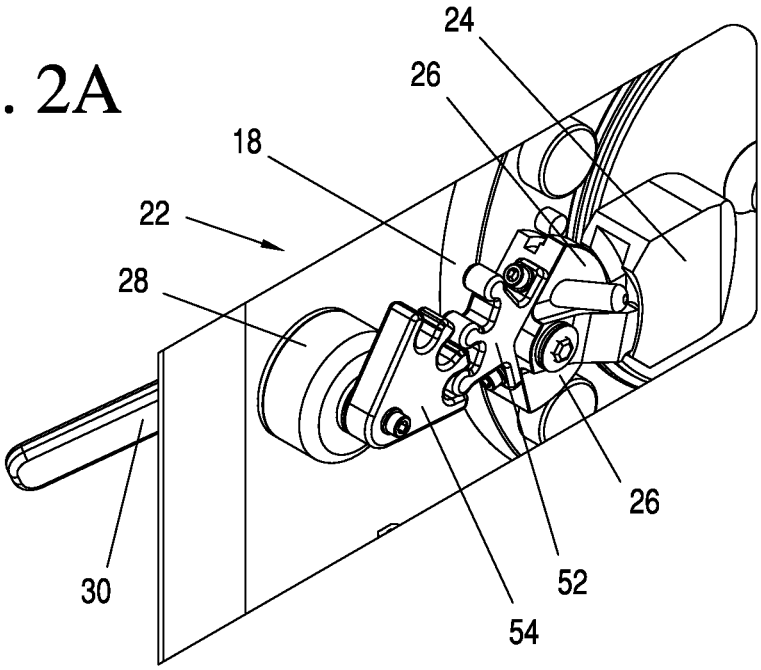
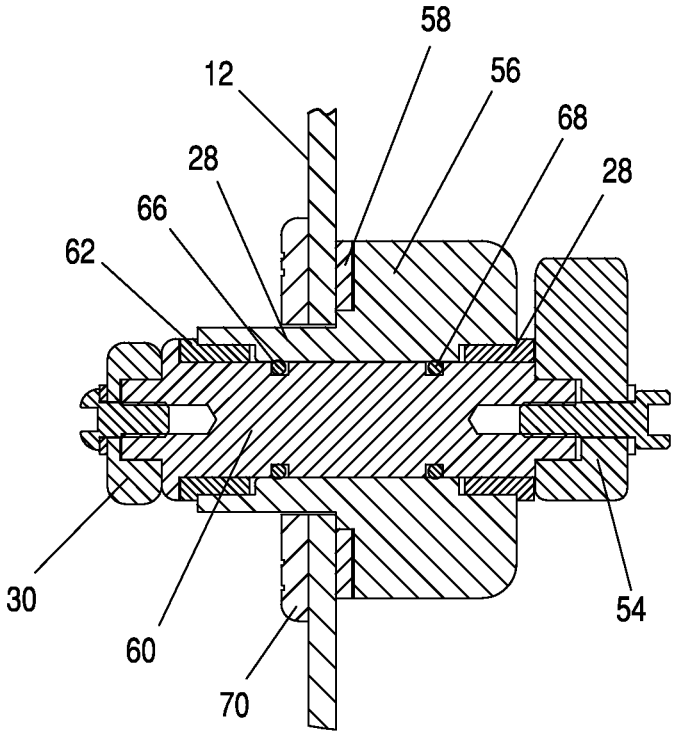
FIG. 2B

EXTERNALLY OPERATED ALPHA PORT SYSTEM FOR USE WITH A RAPID TRANSFER PORT

BACKGROUND OF THE INVENTION

1. Field of the Invention

This invention relates to rapid transfer port (RTP) systems for transferring articles between two environments, such as an isolator barrier chamber (the alpha flange side) and a transfer container (the beta flange side) that are adapted to be brought into close proximity to one another by a docking operation. More particularly, the present invention relates to an externally operated alpha port system that includes means for locking/unlocking and operating its door without requiring access to the internal volume of the isolator barrier chamber.

2. Description of the Related Art

Certain manufacturing processes require the maintenance of separation between two environments to avoid contamination of the cleaner of the two environments by the dirtier of the two. This is accomplished with the use of environments such as isolation barriers. For example, in the case of certain pharmaceutical products, the manufacturing process is performed within these isolation barriers to prevent contamination of the product being produced by dust particles, bacteria and viruses which are found in the outside ambient air. The same holds true for the assembly of certain medical devices. In the case of radioactive operations or bacteriological procedures, the environment within the isolation barrier is dirty as compared to the outside ambient air. In these cases, the isolation barrier serves the function of keeping the product being handled from escaping into the external environment.

In recent years, in the pharmaceutical industry, because of the expense and operational difficulties of maintaining so-called "clean rooms" into which operators enter to carry out procedures, the use of isolation barriers has become common practice. The isolation barriers, in concept large glove boxes, are integrated onto the machinery used to carry out the necessary manufacturing operations. Examples of such isolation barriers are those disclosed in U.S. Pat. No. 6,010,400 and U.S. Pat. No. 8,012,228. Variation of these isolation barriers is what is commonly known as a RABS, Restricted Access Barrier System.

Means for transferring components, product, supplies, etc. into and out of these isolation barriers without risk of contamination of the components being transferred by the "dirty" external environment during the docking and components transfer process must be provided. To accomplish this, isolator barrier chambers and RABS feature devices generally called Rapid Transfer Ports (RTP). These RTP devices may be of various type, size and configuration. A common type of RTP device is one that is offered by the French company La Calhene, referred to as the DPTE.

The DPTE port is disclosed in U.S. Pat. Nos. 3,682,208 and 3,289,698 and further disclosed to include an electrical interlocking system in U.S. Pat. No. 4,494,586 and a mechanical interlocking system in U.S. Pat. No. 5,421,626. A further variation of the DPTE type RTP port is that disclosed in U.S. Pat. No. 6,308,749 in which a lighting system provide means for sterilizing the materials being transferred into the isolator barrier chamber.

There are numerous RTP ports available other than the DPTE type RTP port. Some of these ports are disclosed in U.S. Pat. No. 5,139,318, U.S. Pat. No. 5,425,400, U.S. Pat. No. 5,460,439, U.S. Pat. No. 5,783,156, U.S. Pat. No. 5,892,200 and U.S. Pat. No. 6,779,567.

The typical RTP port is composed of two major components, the alpha port and the beta flange. Typically, the alpha flange is the half of the RTP port that is permanently mounted onto the isolator barrier chamber. The alpha port consists of the alpha flange that features the mounting means for attachment to the wall of the isolator barrier chamber and the alpha door that is hinged to the alpha flange and provides operator access into the isolator barrier chamber when opened.

The other major component of the RTP port system is the beta flange that docks to the alpha flange to gain access to the isolator barrier chamber internal volume.

A typical application of the RTP port system is to dock a beta canister such as that disclosed in U.S. Pat. No. 6,655,759 to the alpha port located on the isolator barrier chamber, reaching into the isolator barrier chamber via a glove attached to a gloveport located in close proximity to the RTP port system and then opening the alpha/beta door to complete the docking and perform the materials transfer. In some applications, the operator, also via a gloveport, positions a funnel at the outlet side of the alpha port to facilitate the transfer of the internal component into the isolator barrier chamber. One example of such transfers is that of small rubber stoppers that are used to seal off vials after aseptic filling operations internal to the isolator barrier chamber. Gloves are considered to be a primary source of contamination in isolator barrier chambers. The integrity of the gloves can be affected by small cuts and pinholes resulting from the manual operations performed. In addition, the manual operation of unlatching and opening the alpha door is somewhat undesirable from an ergonomic standpoint when performed through a glove.

Clearly then, it is desirable to provide means for latching/unlatching and opening/closing the RTP port system door without entering the isolator barrier chamber volume and a number of patents disclose various means for achieving such.

One system is that disclosed in U.S. Pat. No. 3,665,958 in which an external actuator and a spring biased closing system actuate a door of a vessel for the nuclear industry. Although not a transfer port of the RTP type, this patent shows the need for such a system in an industry other than the pharmaceutical industry. Similarly, U.S. Pat. No. 4,324,344 shows an external door closing system on a pressure vessel, not a pharmaceutical application but just the same in need of such an external actuating system.

U.S. Pat. Nos. 4,532,970, 4,534,389 and 4,616,683 demonstrate another method for actuation of the RTP port system door without entry into the isolator barrier chamber. Although the application of the above patents is for the electronics manufacturing industry, the alpha/beta port is of the RTP type that is readily used in the pharmaceutical industry. The actuation method of this invention is that of an electro-mechanical door drive system which is also seen in U.S. Pat. No. 4,724,874. U.S. Pat. No. 5,460,439 describes a system for the pharmaceutical industry that addresses both issues described above regarding the opening/closing of the RTP port system door and the positioning of a collar that is engaged during material transfer. The movement of the devices that perform the described functionality is provided by a motorized drive system that, via a control system, creates the necessary motion. This patent does not include means for locking/unlocking the door into its closed position, a necessary functionality of a manually operated system.

U.S. Pat. No. 5,139,318 discloses a transfer system that permits latching and opening of the port door without gloved access to the interior of the chamber. This patent also discloses an axially moving mechanism that separates the door from the port and a rotationally moving mechanism that moves the door away from the port opening. The patent also makes claims as to the sealing arrangement between the port door and the container lid. Although this patent addresses the issues described in the background above, it is clearly suitable for the nuclear industry but has a number of limitations in its use for the pharmaceutical industry where cleanliness and total surface exposure to decontaminating agents are key process requirements. Specifically, the axial movement of the door mechanism does not permit total surface coverage in the translating mechanism. In addition, this port system is not of the type commonly known as the alpha/beta port system. The alpha/beta port system, commonly used in the pharmaceutical industry, simply requires relative rotation of the beta flange relative to the alpha flange to complete the docking process. The port system described in U.S. Pat. No. 5,139,318 requires an additional mechanism to complete the docking, therefore adding "dirty" mechanical components on the sterile (internal) side of the isolator barrier chamber.

The invention described below addresses the issues listed in the background above in such a manner as to being compatible with the requirements of the pharmaceutical industry.

SUMMARY

In a broad aspect the present invention is an externally operated alpha port system for a rapid transfer port (RTP) system. It includes a mounting plate sealingly attached to an isolator barrier chamber having an RTP port system. An alpha port assembly includes a flange assembly fixed to the mounting plate; and, a door assembly hingedly connected to the flange assembly configured to swing into an internal volume of the isolator barrier chamber. A door locking actuator assembly includes a first door locking element fixed to the door assembly. A second door locking element is rotatably attached to the flange assembly configured to operatively engage with the first door locking element. A door locking body assembly is fixedly attached to the mounting plate in a sealed manner, the door locking body assembly defining a first opening extending through the mounting plate. The door locking body assembly is configured to operatively engage the second door locking element. A door locking lever is operatively connected to the door locking body assembly and extends through the first opening to provide door locking functionality from a position external to the isolator barrier chamber. A door opening actuator assembly includes a first door hinge element fixed to the flange assembly. A second door hinge element is fixed to the door assembly and rotatably attached to the first door hinge element. A door opening body assembly is fixedly attached to the mounting plate in a sealed manner, the door opening body assembly defining a second opening extending through the mounting plate. The door opening body assembly is configured to operatively engage the second door hinge element. A door opening lever assembly is operatively connected to the door opening body assembly and extends through the second opening to provide door opening functionality from a position external to the isolator barrier chamber. To unlock and open the door assembly a user first actuates the door locking lever and then actuates the door opening lever assembly. To close and lock the door assembly the user actuates the door opening lever assembly and then actuates the door locking lever.

BRIEF DESCRIPTION OF THE DRAWINGS

FIG. 2A is a perspective view of the door locking actuator assembly.

FIG. 2B is a section view of the door locking actuator assembly.

Other objects, advantages, and novel features will become apparent from the following detailed description of the invention when considered in conjunction with the accompanying drawings.

DETAILED DESCRIPTION OF THE INVENTION

Figure 1:
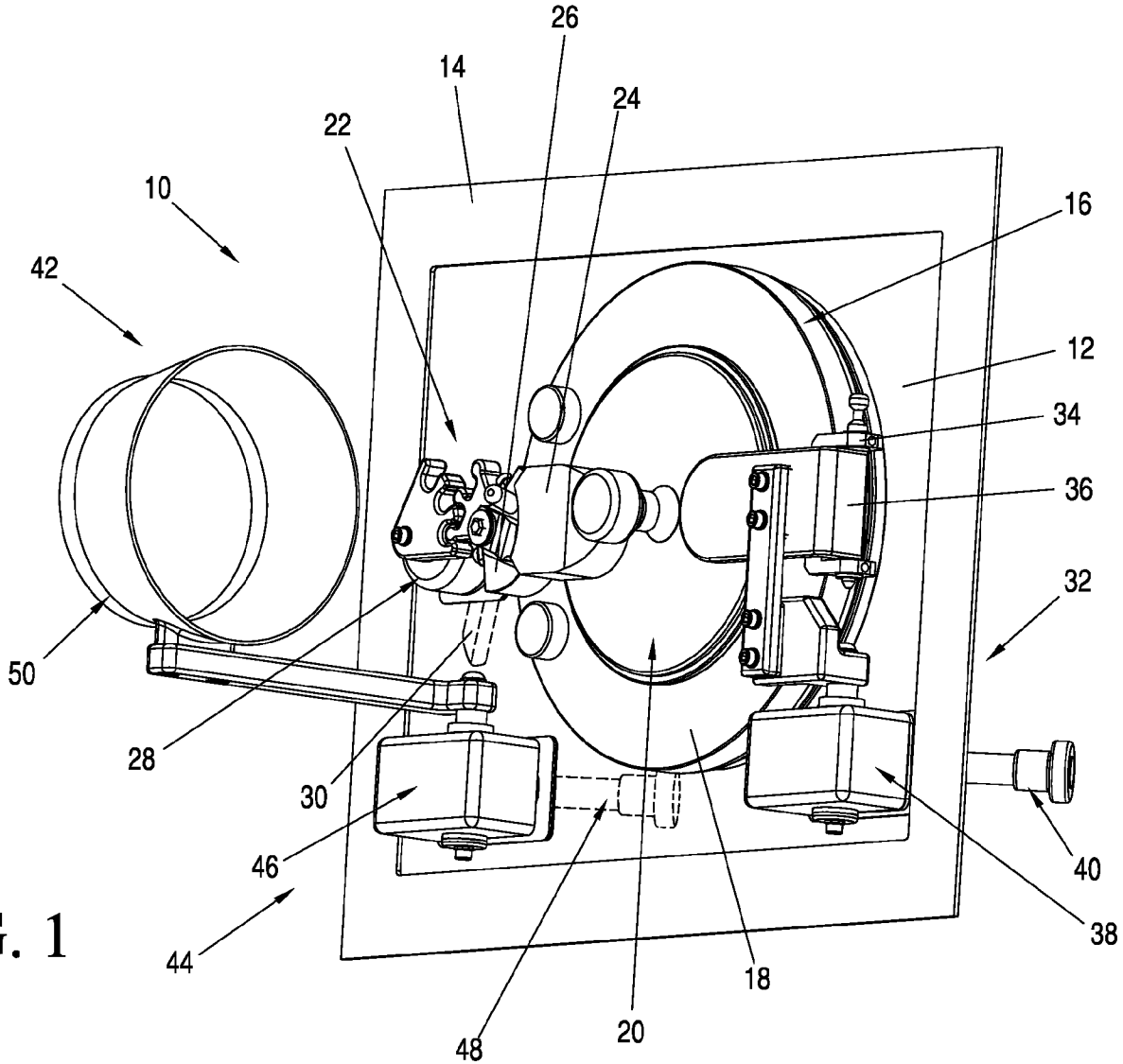
FIG. 1 is a front, side perspective view of the non-operator (sterile) side of the alpha port system of the present invention.
Figure 3A:
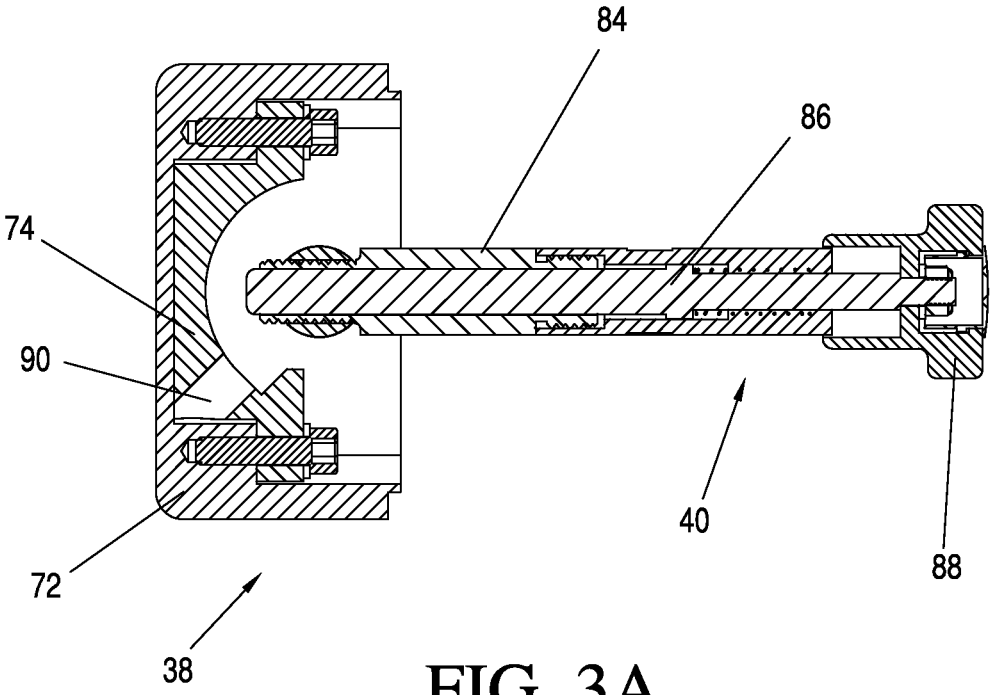
FIG. 3A is a top section view of the door opening actuator assembly.
Figure 3B:
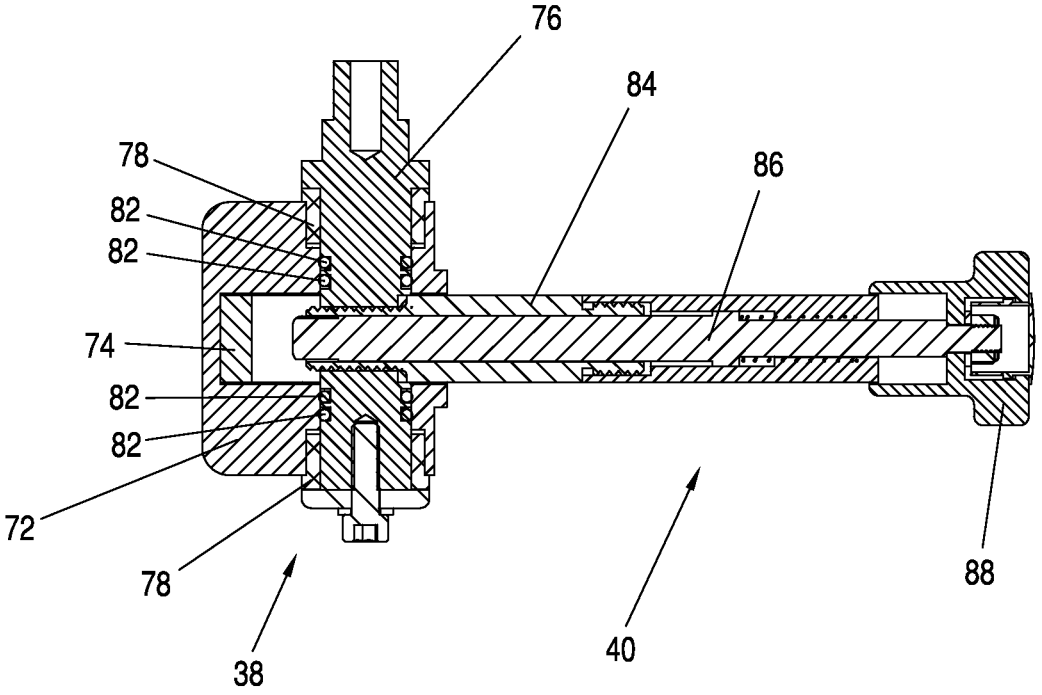
FIG. 3B is a side section view of the door opening actuator assembly.

Referring to the drawings and the characters of reference marked thereon, FIG. 1 illustrates a preferred embodiment of the externally operated alpha port system for a rapid transfer port (RTP) system, of the present invention, designated generally as 10. The alpha port system 10 includes a mounting plate 12 sealingly attached to an isolator barrier chamber 14 having an RTP port system. (The RTP port system is not shown in these figures.)

An alpha port assembly, designated generally as 16, includes a flange assembly 18 fixed to the mounting plate 12. A door assembly 20 is hingedly connected to the flange assembly 18 and is configured to swing into an internal volume of the isolator barrier chamber 14.

A door locking actuator assembly, generally designated as 22, includes a first door locking element 24 fixed to door assembly 20. A second door locking element 26 is rotatably attached to flange assembly 18 and is configured to operatively engage with the first door locking element 24.

A door locking body assembly 28 is attached in a sealed manner to mounting plate 12. Door locking body assembly 28 provides a first opening through mounting plate 12 and is configured to operatively engage second door locking element 26.

A door locking lever 30 (shown in phantom) is operatively connected to door locking body assembly 28 and extends through the first opening in mounting plate 12. Door locking lever 30 provides door locking functionality from a position external to isolator barrier chamber 14.

A door opening actuator assembly, generally designated as 32, includes a first door hinge element 34 that is fixed to flange assembly 18 and a second door hinge element 36 that is fixed to door assembly 20 and is rotatably attached to the first door hinge element 34.

Door opening actuator assembly 32 also includes a door opening body assembly 38 fixedly attached in a sealed manner to mounting plate 12. Door opening body assembly 38 provides a second opening through mounting plate 12 and is configured to operatively engage the second door hinge element 36.

Door opening actuator assembly 32 also includes a door opening lever assembly 40 that is operatively connected to door opening body assembly 38 and extends through the second opening in the mounting plate 12. Door opening lever assembly 40 provides door opening functionality from a position external to isolator barrier chamber 14.

To unlock and open door assembly 20 a user first actuates door locking lever 30 and then actuates door opening lever assembly 40. To close and lock door assembly 20 the user first actuates door opening lever assembly 40 and then actuates door locking lever 30.

The present invention preferably includes a funnel assembly, generally designated as 42, that the operator might use to facilitate the introduction of small assembly components such as rubber stoppers into the isolator barrier chamber. Funnel assembly 42 is comprised of a funnel actuator assembly 44 and a funnel 46. Funnel actuator assembly 44 is fixedly attached in a sealed manner to mounting plate 12 and includes a funnel actuator body assembly 46 that defines a third opening extending through mounting plate 12 and a funnel actuator lever assembly 48.

Funnel actuator lever assembly 48 is operatively connected to funnel actuator body assembly 46 and extends through the third opening in mounting plate 12 to provide funnel positioning functionality from a position external to isolator barrier chamber 14.

Funnel assembly 42 also includes a funnel 50 that is operably connected to funnel actuator assembly 44.

Referring more specifically to FIGS. 2A and 2B the door locking actuator assembly 22 preferably includes a first gear element 52 operatively connected to the second door locking element 26 and a second gear element 54 operatively connected to door locking body assembly 28 wherein the first gear element 52 and the second gear element 54 provide operative engagement of the door locking body assembly 28 and the second door locking element 26.

The door locking actuator assembly 22 includes a door locking body 56 attached to mounting plate 12 and applying compression to gasket 58 and providing mounting means for bezel 70. Rotatably located within door locking body 56 is pivot shaft 60 with o-ring 66 and o-ring 68 providing the sealing functionality and the bushing 62 and bushing 64 providing mechanical guidance and centering. Pivot shaft 60 includes attachment means for the door locking lever 30 at one end and the second gear element 54 at the other end wherein the actuation of door locking lever 30 causes the same actuation of the second gear element 54.

Referring more specifically to FIGS. 3A, 3B, 4 and 5 the door opening body assembly 38 preferably includes a door opening body 72 having a door opening receptacle 74. Door opening body assembly 38 also includes door opening shaft 76 sealingly and rotatably positioned within the door opening body 72. Door opening shaft 76 is configured to mount door opening lever assembly 40. Door opening shaft 76 includes o-rings 82 for sealing against door opening body 72 and bushings 78 for guidance and centering within door opening body 72.

Figure 4:
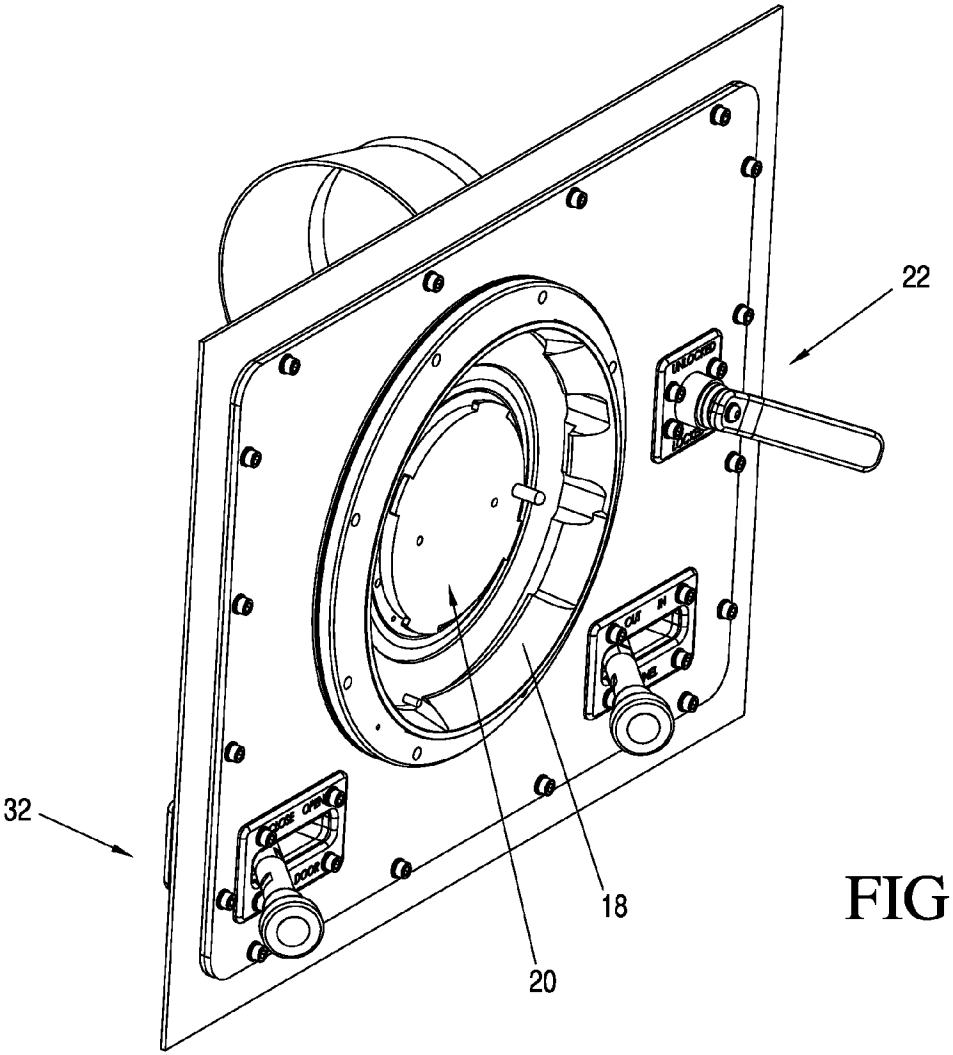
FIG. 4 is a front, side perspective view of the operator (non-sterile) side showing the door assembly in the closed position.
Figure 5:
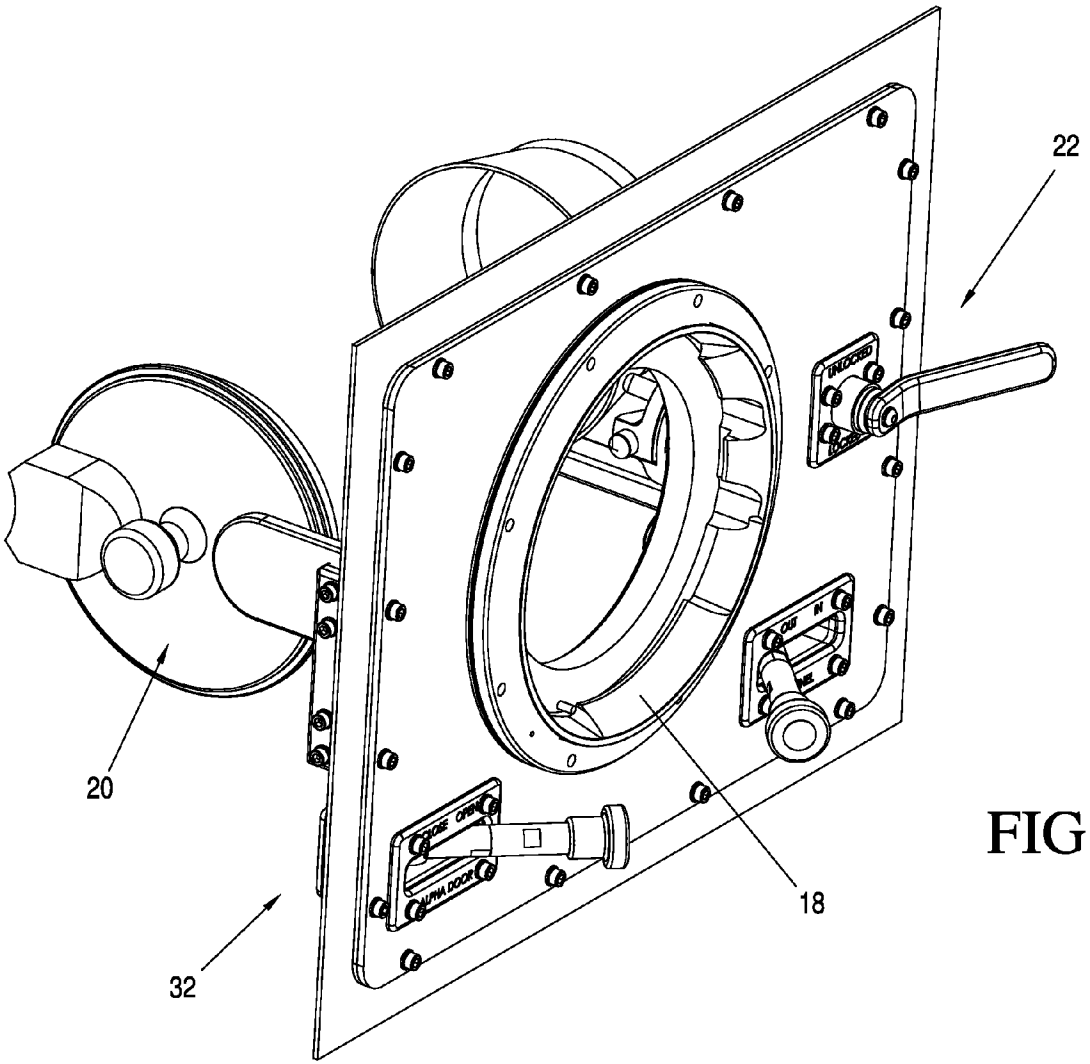
FIG. 5 is a front, side perspective view of the operator (non-sterile) side showing the door assembly in the open position.
Figure 6A:
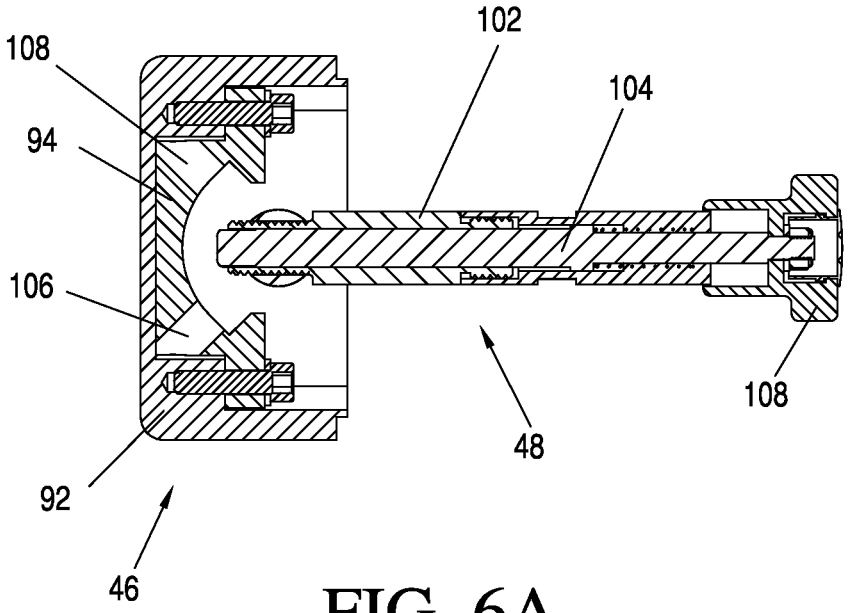
FIG. 6A is a top section view of the funnel engage/disengage actuator assembly.
Figure 6B:
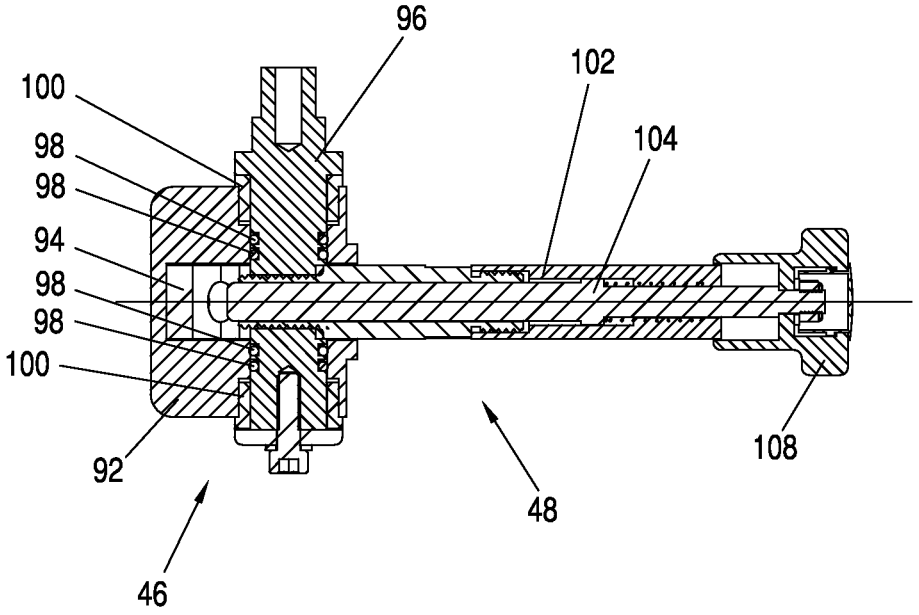
FIG. 6B is a side section view of the funnel engage/disengage actuator assembly.

Door opening lever assembly 40 includes door opening lever outer shaft 84 mounted to door opening shaft 76 and door opening lever inner shaft 86 slideably positioned within the door opening lever outer shaft 84 for engagement with door opening receptacle 74. The door opening body assembly 38 and the door opening lever assembly 40 are configured to swing and lock door assembly 20 to an open position. Locking door assembly 20 in the open position is achieved by the engagement of the door opening lever inner shaft 84 into the door open pocket 90 of door opening receptacle 74 with the aid of door opening lever knob 88 that is attached to door opening lever inner shaft 86. FIG. 4 illustrates door assembly 20 in the closed position and into contact with flange assembly 18. FIG. 5 illustrates door assembly 20 in the open position and in an orientation perpendicular to flange assembly 18.

Referring more specifically to FIGS. 6A, 6B, 7 and 8 the funnel actuator body assembly 46 preferably includes a funnel actuator body 92 having a funnel actuator receptacle 94. Funnel actuator body assembly 46 also includes a funnel actuator shaft 96 sealingly and rotatably positioned within funnel actuator body 92. Funnel actuator shaft 96 is configured to mount funnel actuator lever assembly 48. Funnel actuator shaft 96 includes o-rings 98 for sealing against funnel actuator body 92 and bushings 100 for guidance and centering within funnel actuator body 92.

Figure 7:
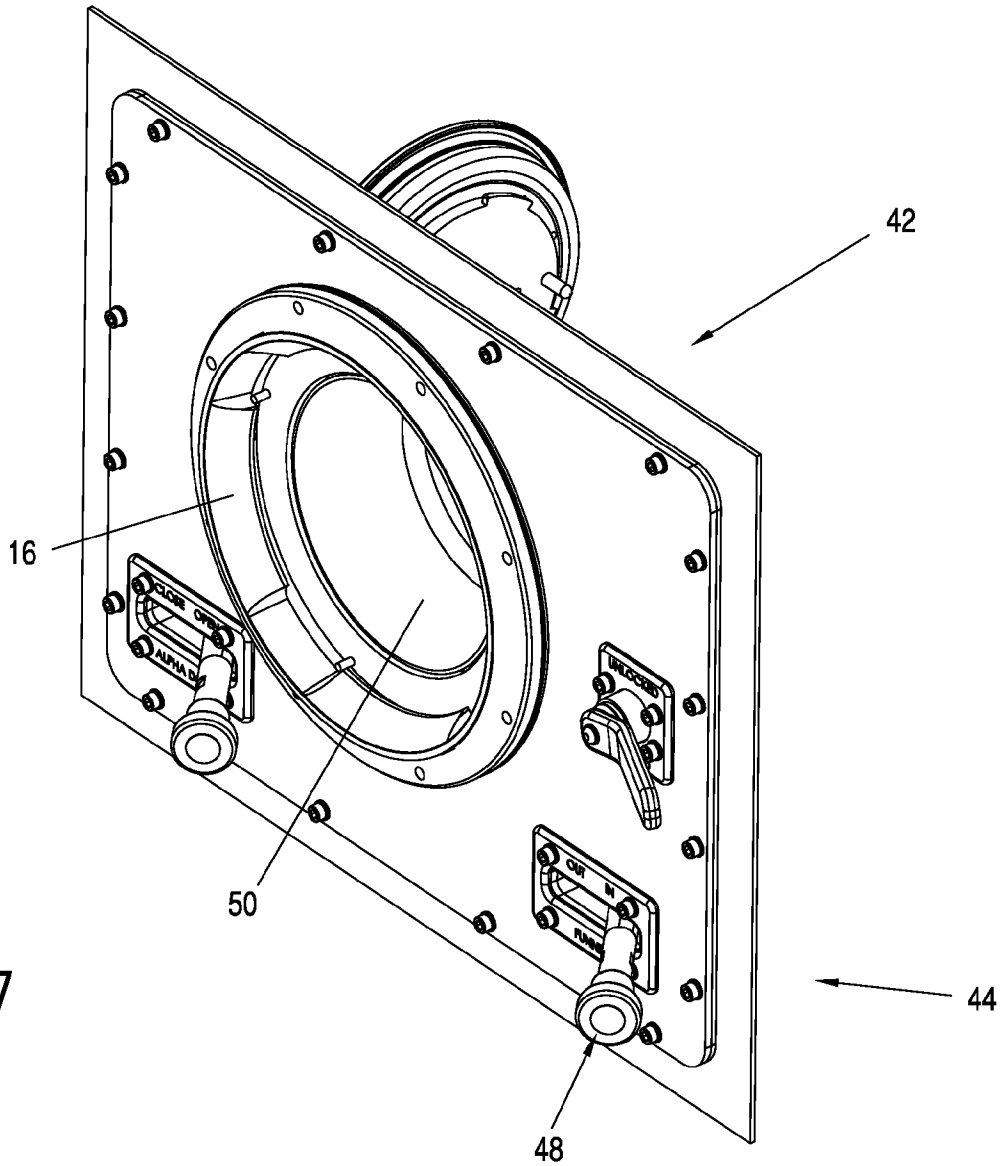
FIG. 7 is a front, side perspective view of the operator (non-sterile) side showing the funnel assembly in the engaged position.
Figure 8:
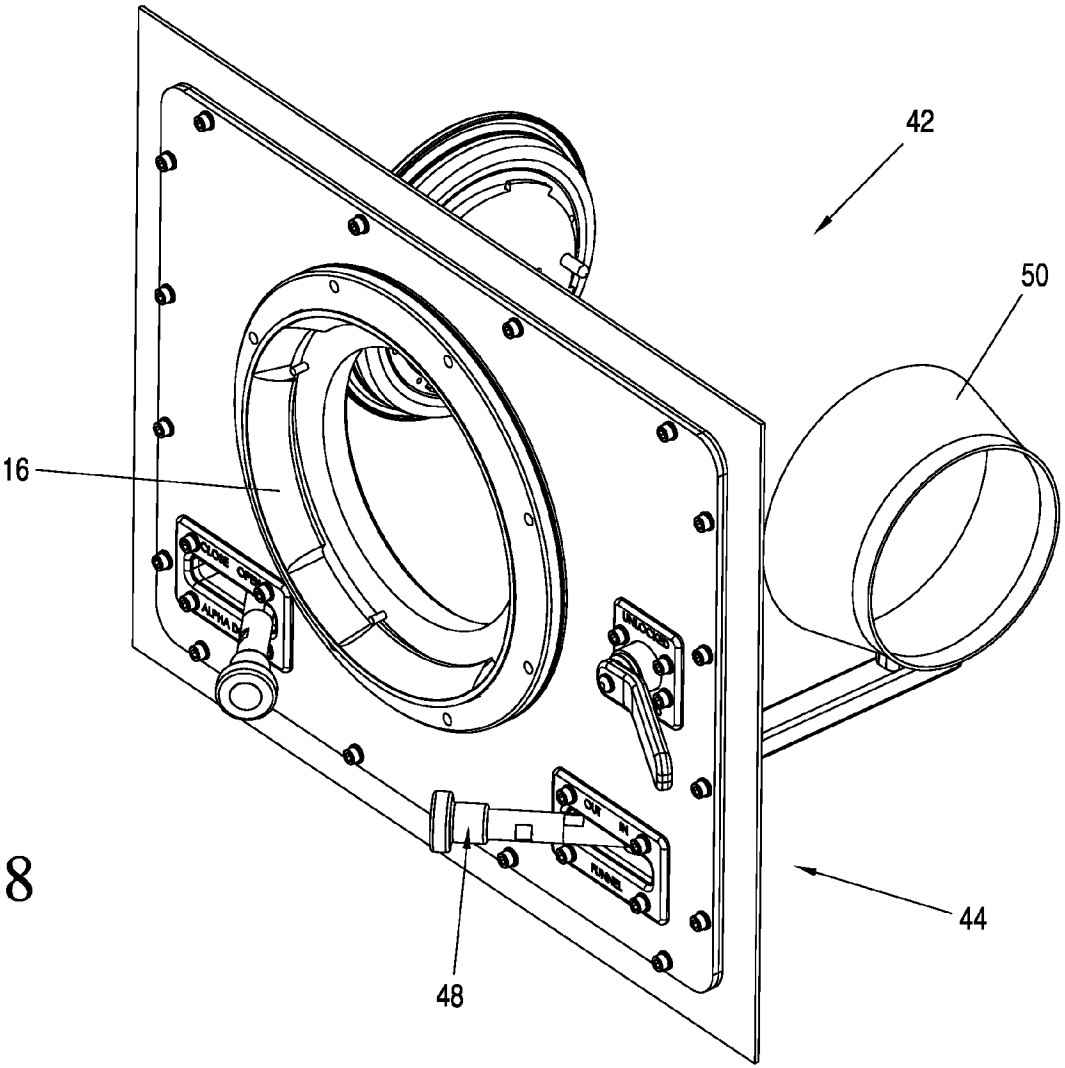
FIG. 8 is a front, side perspective view of the operator (non-sterile) side showing the funnel assembly in the disengaged position.

Funnel actuator lever assembly 48 includes funnel actuator lever outer shaft 102 mounted to funnel actuator shaft 96 and funnel actuator lever inner shaft 104 slideably positioned within funnel actuator lever outer shaft 102 for engagement with funnel actuator receptacle 94. The funnel actuator body assembly 46 and the funnel actuator lever assembly 48 are configured to swing funnel 50 in range from an aligned position with alpha port assembly 16 to a defined distance position from alpha port assembly 16 and lock funnel 50 in the aligned position or the defined distant position. Locking funnel 50 in the aligned position is achieved by the engagement of the funnel actuator lever inner shaft 104 into funnel aligned pocket 106 of funnel actuator receptacle 94 with the aid of funnel actuator lever knob 108 that is attached to funnel actuator lever inner shaft 104. Locking funnel 50 in the distant position is achieved by the engagement of the funnel actuator lever inner shaft 104 into funnel distant pocket 108 of funnel actuator receptacle 94 with the aid of funnel actuator lever knob 108 that is attached to funnel actuator lever inner shaft 104. FIG. 7 illustrates funnel assembly 42 in the aligned position with alpha port assembly 16. FIG. 8 illustrates funnel assembly 42 in the distant position from alpha port assembly 16.

The component design and the materials of construction of the present invention are compatible with cleaning and sterilization processes that are typical of pharmaceutical aseptic processes. For example, the cleaning process might consist of a wash down using Water-for-Injection (WFI) water, not too aggressive of an agent. On the other hand, aggressive cleaning agents such as bleach and other detergent solutions may alternatively be used. The sterilization/decontamination process usually consists of a timed exposure of the interior volume of the barrier isolator to Vapor Hydrogen Peroxide (VHP) gas. This gas is highly corrosive to certain plastics and metals. Given the above, the selection of materials of construction is generally limited to corrosion resistant metals such as 300 series stainless steels, silicone rubber for sealing components and polyethylene or polycarbonate for plastic components. The design of the system's components and assemblies should minimize the number of hard to clean crevices that could be a harbor for contamination that could potentially effect the quality of the manufacturing process.

The flange assembly is similar to the one commonly known as the DPTE Alpha Flange manufactured by the French company, La Calhene. The La Calhene alpha flange is considered the standard of the industry. Although modified to permit its integration into the present invention, critical functional features of the flange, such as the door interlocking system and its ability to dock to a beta flange while maintaining asepsis remain. These integration principles and modifications apply to other RTP port manufacturers, such as, for example, the RTP manufactured by the US company Central Research Laboratories.

The present invention can be configured to match the requirements of the application. More specifically, the configuration shown in FIG. 4 has the door locking actuator to the right of the flange assembly, the funnel actuator at the lower right of the system and the door opening actuator at the lower left. A reverse configuration of the system would place the door locking actuator to the left of the flange assembly, the funnel actuator at the lower left of the system and the door opening actuator at the lower right. Another possible configuration of the system is a vertical orientation of the movements. More specifically, the system can be configured to have the door locking actuator above the flange assembly and the funnel and door opening actuators to either the left or the right of the flange assembly.

The orientation of the system shown in FIG. 4 is vertical. It is quite common that the transfer of the components into the barrier isolator system is made using gravity as the part conveying driver. To facilitate the process for those applications, the system can be oriented in an angle differing from vertical. For example, a 45 degree tilt of the system would allow docking a reservoir filled with sterilized rubber stoppers to the system and the automatic transfer of the stoppers into a receiving system within the barrier isolator without intervention by the operator. To further meet the requirements of the application, the geometric configuration of the funnel can be adapted to deliver the components to be transferred directly and precisely into the receiving device inside the barrier isolator system.

The embodiment described is directed to operations that require manual intervention by the operator to perform the sequential steps of the process: Docking of the beta canister to the alpha flange, unlocking of the alpha door, opening of the alpha door, engagement of the funnel and then delivery of the components to be transferred. Clearly some of the steps of the sequence could be automated by incorporating motorized or pneumatic drives to the three mechanisms of the system, the door locking actuator, the door opening actuator and the funnel actuator. Such automatic functionality would require the integration of control components to perform the required operational sequences without risk of injury to the operator and equipment damage.

Although the invention here described is directed mostly for use in the pharmaceutical industry, it is understood that it is equally applicable to the nuclear industry, the medical devices industry, and any other industry requiring transfer of materials through a barrier wall without intermingling of the environments on opposite sides of the barrier wall.

Obviously, many modifications and variations of the present invention are possible in light of the above teachings. It is, therefore, to be understood that within the scope of the appended claims, the invention may be practiced otherwise than as specifically described.

What is claimed and desired to be secured by Letters Patent of the United States is:

1. An externally operated alpha port system for a rapid transfer port (RTP) system, comprising:

a) a mounting plate sealingly attached to an isolator barrier chamber having an RTP port system;

b) an alpha port assembly, comprising:

i. a flange assembly fixed to said mounting plate;

ii. a door assembly hingedly connected to said flange assembly configured to swing into an internal volume of said isolator barrier chamber;

c) a door locking actuator assembly, comprising:

i. a first door locking element fixed to said door assembly;

ii. a second door locking element rotatably attached to said flange assembly configured to operatively engage with said first door locking element;

iii. a door locking body assembly fixedly attached to said mounting plate in a sealed manner, said door locking body assembly defining a first opening extending through said mounting plate, said door locking body assembly configured to operatively engage said second door locking element;

iv. a door locking lever operatively connected to said door locking body assembly and extending through said first opening to provide door locking functionality from a position external to said isolator barrier chamber;

d) a door opening actuator assembly, comprising:

i. a first door hinge element fixed to said flange assembly;

ii. a second door hinge element fixed to said door assembly and rotatably attached to said first door hinge element;

iii. a door opening body assembly fixedly attached to said mounting plate in a sealed manner, said door opening body assembly defining a second opening extending through said mounting plate, said door opening body assembly configured to operatively engage said second door hinge element;

iv. a door opening lever assembly operatively connected to said door opening body assembly and extending through said second opening to provide door opening functionality from a position external to said isolator barrier chamber, wherein to unlock and open said door assembly a user first actuates said door locking lever and then actuates said door opening lever assembly, and to close and lock said door assembly the user actuates said door opening lever assembly and then actuates said door locking lever.

2. The alpha port system of claim 1, further comprising a funnel assembly, comprising:

a) a funnel actuator assembly fixedly attached to said mounting plate in a sealed manner, said funnel actuator assembly comprising:

i. a funnel actuator body assembly defining a third opening extending through said mounting plate; and, ii. a funnel actuator lever assembly operatively connected to said funnel actuator body assembly and extending through said third opening to provide funnel positioning functionality from a position external to said isolator barrier chamber;

b) a funnel operably connected to said funnel actuator assembly.

3. The alpha port system of claim 1, wherein said door locking actuator assembly, further comprises:

a) a first gear element operatively connected to said second door locking element; and, b) a second gear element operatively connected to said door locking body assembly, said first gear element and said second gear element providing said operative engagement of said door locking body assembly and said second door locking element.

4. The alpha port system of claim 1, wherein:

a) said door opening body assembly, comprises:

i. a door opening body having a door opening receptacle;

ii. a door opening shaft sealingly and rotatably positioned within said door opening body, said door opening shaft being configured to mount said door opening lever assembly;

b) said door opening lever assembly, comprises:

i. a door opening lever outer shaft mounted to said door opening shaft;

ii. a door opening lever inner shaft slideably positioned within said door opening lever outer shaft for engagement with said door opening receptacle, wherein said door opening body assembly and said door opening lever assembly are configured to swing said door assembly to an open position and lock said door assembly in said open position.

5. The alpha port system of claim 1, wherein:

a) said funnel actuator body assembly, comprises:

i. a funnel actuator body having a funnel actuator receptacle;

ii. a funnel actuator shaft sealingly and rotatably positioned within said funnel actuator body, said funnel actuator shaft being configured to mount said funnel actuator lever assembly;

b) said funnel actuator lever assembly, comprises:

i. a funnel actuator lever outer shaft mounted to said funnel actuator shaft;

ii. a funnel actuator lever inner shaft slideably positioned within said funnel actuator lever outer shaft for engagement with said funnel actuator receptacle, wherein said funnel actuator body assembly and said funnel actuator lever assembly are configured to swing said funnel in range from an aligned position with said alpha port assembly to a defined distant position from said alpha port assembly and lock said funnel in said aligned position or said defined distant position.

* * * * *